US005495074A

United States Patent [19]

Kondo et al.

[11] Patent Number: 5,495,074

[45] Date of Patent: Feb. 27, 1996

[54] KEYBOARD UNIT FOR ELECTRONIC MUSICAL INSTRUMENT HAVING A KEY MOTION DETECTORS

[75] Inventors: Masao Kondo; Keisuke Watanabe, both of Hamamatsu, Japan

[73] Assignee: Yamaha Corporation, Japan

[21] Appl. No.: 63,411

[22] Filed: May 18, 1993

[30] Foreign Application Priority Data

May 20, 1992 [JP] Japan ..... 4-033145 U
Sep. 10, 1992 [JP] Japan ..... 4-242353

[51] Int. Cl.[6] ..... G10H 1/055; G10H 1/34

[52] U.S. Cl. ..... 84/690; 84/719; 84/DIG. 7

[58] Field of Search ..... 84/615, 626–633, 84/658, 662–665, 687–690, 701–711, 719, 720, DIG. 7

[56] References Cited

U.S. PATENT DOCUMENTS 1,853,630 4/1932 Martenot ..... 84/706
1,914,831 6/1933 Martenot ..... 84/706
4,615,252 10/1986 Yamauchi .
4,914,199 4/1990 Masubuchi et al. ..... 84/DIG. 7
5,107,748 4/1992 Muramatsu et al. .

FOREIGN PATENT DOCUMENTS 62-188798 12/1987 Japan .

*Primary Examiner*—Stanley J. Witkowski
*Attorney, Agent, or Firm*—Graham & James

[57] ABSTRACT

A keyboard unit for an electronic musical instrument is constructed by a plurality of keys, a key frame, a plurality of key guides and a pressure sensor. On the key frame, a plurality of keys are arranged such that each of them can freely rotate about the predetermined fulcrum point. The key guides are provided on the key frame, while each of the key guides supports each of the keys such that each of the keys can slide along guide surfaces of each of the key guides when the key is depressed. The pressure sensor is provided at the guide surface of the key guide. This pressure sensor senses the pressure applied thereto in a lateral direction corresponding to a disposing direction of the keys in the keyboard unit when the key is depressed. When the key is moved in the lateral direction while being depressed down, the pressure sensor senses the pressure applied to the key in the lateral direction so that the predetermined musical parameter (e.g., tone pitch) of the musical tone to be generated is controlled responsive to the sensed pressure. The pressure sensor can be made by use of the pressure-sensitive rubber or pressure-sensitive ink, of which resistance is altered responsive to the pressure applied to it.

18 Claims, 11 Drawing Sheets

KEYBOARD UNIT FOR ELECTRONIC MUSICAL INSTRUMENT HAVING A KEY MOTION DETECTORS

BACKGROUND OF THE INVENTION

1. Field of the Invention

The present invention relates to a keyboard unit for an electronic musical instrument.

2. Prior Art

Conventionally, the keyboard unit of the electronic musical instrument provides a key switch below the lower-side portion of each of the keys. This key switch produces a key-on signal when a key is depressed. When depressing the key, the key is depressed down in a vertical direction by the predetermined stroke. Hereinafter, such stroke will be denoted to as a key-depression stroke. In the Vicinity of the end zone of this key-depression stroke, there is provided a pressure sensor, by which the musical tone control is performed with respect to the after-touch range of the musical tone. For example, when imparting the vibrato effect to the musical tone, the key is slightly vibrated after the key is depressed down by the key-depression stroke. At this time, the vibrating motion of the key causes the variation of the pressure applied to the key, which is sensed by the pressure sensor so as to perform the frequency modulation on the musical tone so that the tone pitch will be altered regularly.

In the conventional keyboard unit, the above-mentioned musical tone control (e.g., vibrato effect) is performed on the musical tone with respect to the after-touch range only after the key-stroke range is ended. This provide a limitation to the performability of the keyboard. In other words, the control range for the musical tone cannot be sufficiently enlarged, which causes a drawback in that the sufficient performability for the musical tones cannot be obtained.

When observing the structure of the keyboard, in order to slightly alter the tone pitch designated by the key-on signal corresponding to the depressed key, the conventional electronic musical instrument is designed to arrange the keys such that each of the keys can be moved in a lateral direction of the keys to be disposed. In response to the lateral-deviating motion of the key to be depressed, the tone pitch is controlled.

In the keyboard unit providing the above-mentioned structure, the key-guide unit in which the keys are arranged is stored in and supported by the key-frame unit. This key-frame unit, as a whole, is attached to the keyboard instrument such that it can freely move. On the basis of the result of the detection of the motion of the key-frame unit, the tone pitch is controlled.

As described above, the key-frame unit as a whole is moved against the keyboard instrument so as to detect the movement of the key-frame unit. Therefore, it is necessary to move the key-frame unit as a whole in a lateral direction by the relatively large physical power. In order to move the key-frame unit in a lateral direction, the whole structure of the keyboard unit must be enlarged and complicated.

Since the key-frame unit provides some printed circuit boards in which several kinds of electronic circuits are fabricated, these printed circuit boards must be moved when the key-frame unit is moved. Due to the repeating movements of the key-frame unit, the electronic circuits and connection cables car be damaged soon, which deteriorates the reliability and durability of the electronic circuits.

SUMMARY OF THE INVENTION

It is accordingly a primary object of the present invention to provide a keyboard unit of the electronic musical instrument which can improve the performability thereof so as to impart a desirable effect to the musical tones to be generated.

It is another object of the present invention to provide a simple structure for the keyboard unit of the electronic musical instrument in which the keys can be freely moved in a lateral direction when performing the; pitch control on the musical tones.

According to the fundamental structure of the present invention, the keyboard unit for the electronic musical instrument is constructed of a key frame, a plurality of keys and key guides, and a pressure sensor. On the key frame, a plurality of keys are arranged such that each of them can freely rotate about the predetermined fulcrum point. The key guides are provided on the key frame, while each of the key guides supports each of the keys such that each of the keys can slide along guide surfaces of each of the keys guides when the key is depressed. The pressure sensor is provided at the guide surface of the key guide, so that the pressure sensor senses the pressure applied thereto in a lateral direction corresponding to a disposing direction of the keys in the keyboard unit when the key is depressed.

In the above-mentioned structure of the keyboard unit, when the key is moved in the lateral direction while being depressed down, the pressure sensor senses the pressure (or force) applied to the key in the lateral direction so that the predetermined musical parameter (e.g., tone pitch) of the musical tone to be generated is controlled responsive to the sensed pressure.

The pressure sensor can be made by use of pressure-sensitive rubber or pressure-sensitive ink, of which resistance is altered responsive to the pressure applied to it.

BRIEF DESCRIPTION OF THE DRAWINGS

Further objects and advantages of the present invention will be apparent from the following description, reference being had to the accompanying drawings wherein the preferred embodiments of the present invention are clearly shown.

In the drawings.

DESCRIPTION OF THE PREFERRED EMBODIMENTS

Figure 1:
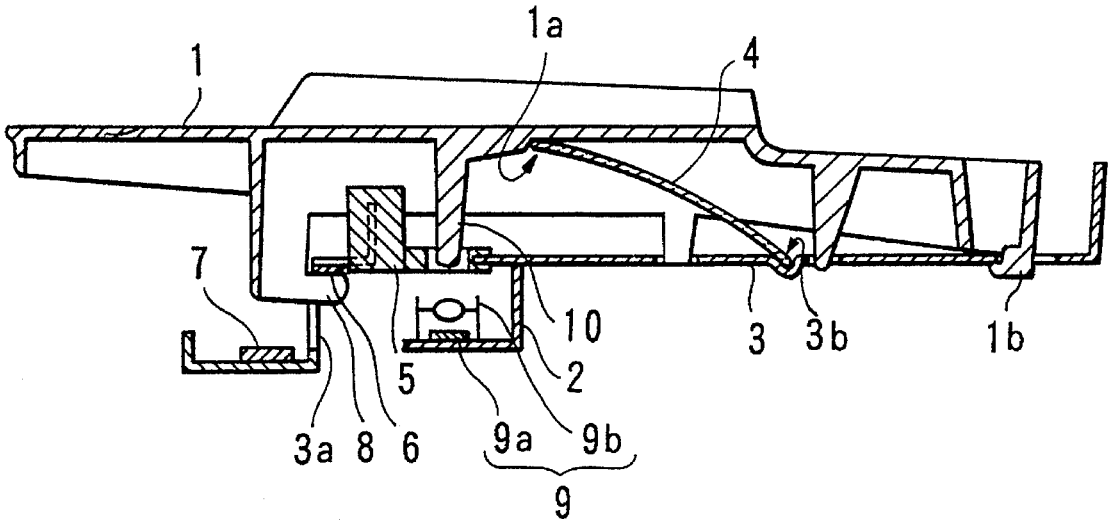
FIG. 1 is a sectional view illustrating the detailed construction of a keyboard unit for the electronic musical instrument according to a first embodiment of the present invention.

Next, the description will be given with respect to a preferred embodiments of the present invention by referring to the drawings, wherein parts identical to those shown in some drawings are designated by the same numerals, hence, the description thereof will be omitted.

[A] First Embodiment (1) Structure of Keyboard Unit

FIG. 1 is a sectional view illustrating the keyboard unit of the electronic musical instrument according to a first embodiment of the present invention. Herein, 1 designates a key (i.e., white key), and a fulcrum member 1*b* is provided as a part of the key 1 at a back-edge portion of the key 1. 4 designates a plate spring, in which one edge portion is engaged with a concave portion 3*b* of a key frame 3, while another edge portion is engaged with a concave portion 1*a* formed at the lower face portion of the key 1. Thus the key 1 is supported on the key frame 3 such that it can freely rotate about the fulcrum member 1*b*. Further, a key guide 5 is engaged with a tip-edge portion of the key frame 3. Herein, the key frame 3 is subjected to the outside molding process so that the tip-edge portion thereof is bent and covered, thus forming the key guide 5. Or, a molding part having a core of which material is different from that of the key frame 3 is formed and then this molding part is inserted into the key frame 3 as the key guide 5. The key 1 is formed in a rectangle shape, and the inside of the key 1 is hollow. Both of the side surfaces (hereinafter, referred to as guide surfaces) of the key guide 5 are sandwiched by both of the side-interior walls of the key 1 (see FIG. 3), and this key 1 can be slid up or down with respect to the key guide 5. When depressing the key 1, the key 1 is rotated while sliding along the guide surfaces of the key guide 5. This structure can avoid the rolling and twisting motion of the key 1 when the key 1 is depressed down by the key-depression stroke.

A hook stopper 8 is formed at the front portion of the key 1 such that it extends downward from the lower surface of the key 1. A through hole 3*a* is formed at a front-face portion of the key frame 3 of which sectional shape is formed by an inverted-L shape (see FIG. 1). The tip-edge portion of the hook stopper 8 is inserted in this through hole 3*a* such that it can freely moved up or down within this through hole 3*a*. Further, there are provided an upper-limit stopper 6 and a lower-limit stopper 7 respectively in the vicinity of the upper-limit portion and lower-limit portion of the through hole 3*a*. Since the hook stopper 8 comes in contact with the upper-limit stopper 6 and lower-limit stopper 7 when the key 1 is moved up or down, the range of the key-depression stroke is limited. FIG. 1 shows a normal condition of the key 1 in which the hook stopper 8 is set in contact with the upper-limit stopper 6. Moreover, the key 1 is normally pressed upward by the foregoing plate spring 4. So, after completing the key-depression motion, the key 1 is returned to the original position at which the hook stopper 8 is placed in contact with the upper-limit stopper 6.

Moreover, an actuator 10 is projected downward from the lower surface of the key 1. A projecting portion 2 having an inverted-L shape is formed at the lower surface of the key frame 3 in response to the above-mentioned actuator 10. Furthermore, a key-switch unit 9 is mounted on a rack portion of the projection portion 2 at the position corresponding to the actuator 10. This key-switch unit 9 contains a fixed contact 9*a* and a movable contact 9*b*. The fixed contact 9*a* is provided on the rack portion of the projecting portion 2, while both-side portions of the movable contact 9*b* are fixed on this rack portion. This movable contact 9*b* further contains an elastic substance having a cylindrical shape which is supported by the both-side portions. When the key 1 is depressed down, tile actuator 10 is moved downward by the key-depression stroke so that the actuator 10 presses down the elastic substance of the movable contact 9*b*. When this movable contact 9*b* is pressed down so that it comes in contact with the fixed contact 9*a*, the key switch (i.e., key-switch unit 9) is turned on. In the present embodiment, the key switch is turned on when the key 1 is depressed down by one third or less of the full key-depression stroke. In other words, the present embodiment neglects the remaining key-depression stroke corresponding to the key-depression period after the elastic substance of the movable contact 9*b* comes in contact with the fixed contact 9*a*.

Incidentally, the construction of the key-switch unit 9 is not limited to that as described above. For example, it is possible to employ the so-called transfer switch in which the contact connecting with the switching element is changed from the first contact to the second contact when the position of the key reaches the predetermined position within the range of the key-depression stroke. In this case, it is preferable that the key-on signal is produced at an early stage of the key-depression stroke.

According to the switching operation of the transfer switch which is made under the operation of the actuator 10, the contact to be connected with the switching element is changed from the first contact to the second, contact when the position of the key reaches the predetermined position within the range of the key-depression stroke. In the conventional keyboard unit, the key-on signal is produced when the switching element comes in contact with the second contact. In contrast, the present embodiment is designed such that the key-on signal is produced just after the switching element leaves the first contact. In short, the present embodiment produces the key-on signal at an earlier timing as compared to the conventional keyboard unit.

Figure 2:
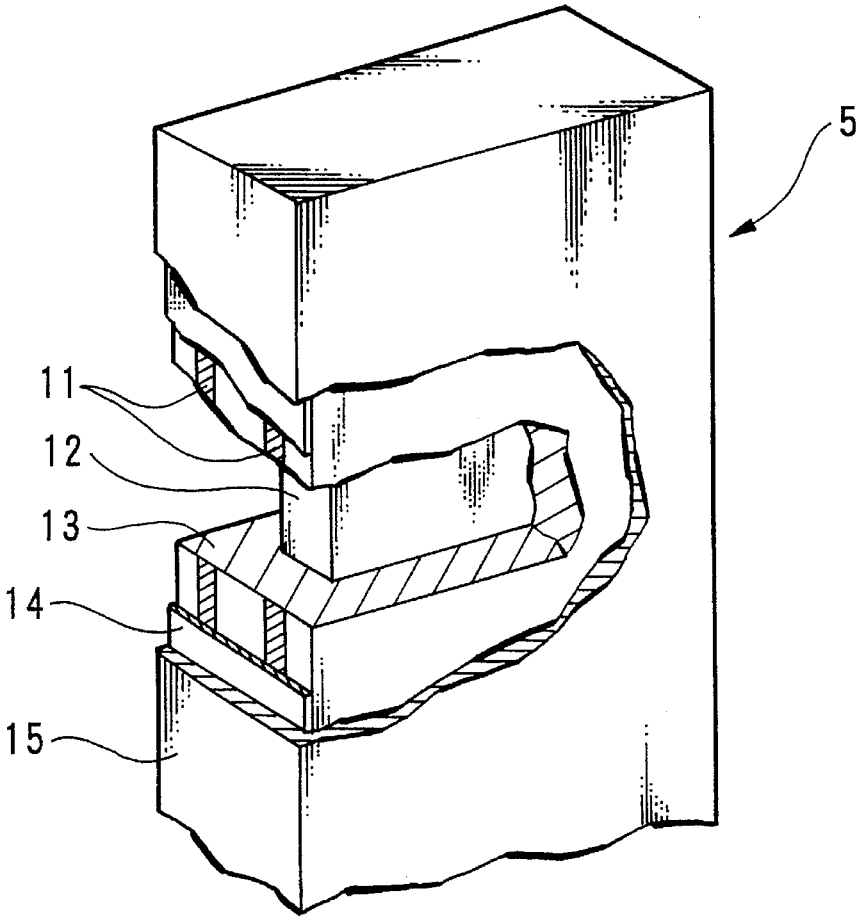
FIG. 2 is a perspective-side view illustrating the detailed construction of a key guide used in the first embodiment.

FIG. 2 illustrates a detailed construction of the key guide 5. This key guide 5 is formed by an outside molding portion 13, pressure-sensitive rubbers 14 and a surface film 15. This outside molding portion 13 is formed around the outside of a core 12 of which material is identical to or different from that of the key frame 3. The pressure-sensitive rubbers 14 are provided at both sides of the outside molding portion 13. This outside molding portion 13 can be formed together with the key frame 3 at its tip-edge portion by the molding process. Or, the outside molding portion 13 can be formed independent of the key frame 3, and then, it is attached to, the tip-edge portion of the key frame 3.

At each side of the molding portion 13, a pair of electrodes 11 are provided. When the pressure-sensitive rubber 14 is pressed, the resistance of the pressed portion of the pressure-sensitive rubber 14 is reduced in response to the pressure applied to it. Normally, the electrodes 11 are placed in contact with the pressure-sensitive rubber 14. However, this rubber 14 has a relatively large resistance, so that the electrodes 11 are not electrically linked together. However, when the resistance of the pressure-sensitive rubber 14 becomes lower than the predetermined threshold value by being pressed, the electrodes 11 are electrically linked together, in other words, the electrodes 11 are conducted with each other. By detecting the conducting event to be occurred between the electrodes 11, it is possible to detect an event in which the pressure is applied to the pressure-sensitive rubber 14. This pressure-sensitive rubber can be replaced by the pressure-sensitive ink. In this case, the electrodes are arranged such that a pressure-sensitive ink layer is sandwiched by them. When the pressure-sensitive ink layer is pressed so that the resistance is reduced in response to the pressure applied to it, the electrodes are conducted with each other. Thus, it is possible to detect the pressure applied to the pressure-sensitive ink layer.

The surface film 15 is made by the material such as the polyethylene fluoride resin (e.g., Teflon, which is the trade mark of Du Ponk Corp. of U.S.) by which the smooth surface can be formed. Such smooth surface of the key guide 5 meets the requirement for the key 1 which slides along the guide surfaces of the key guide 5 smoothly.

Figure 3:
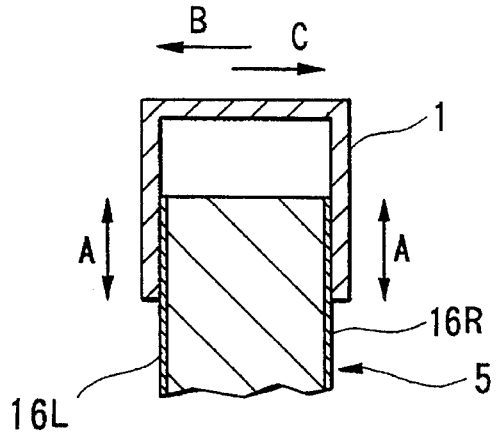
FIG. 3 is a sectional view which is used for explaining a sliding movement between the key and key guide.
Figure 4:
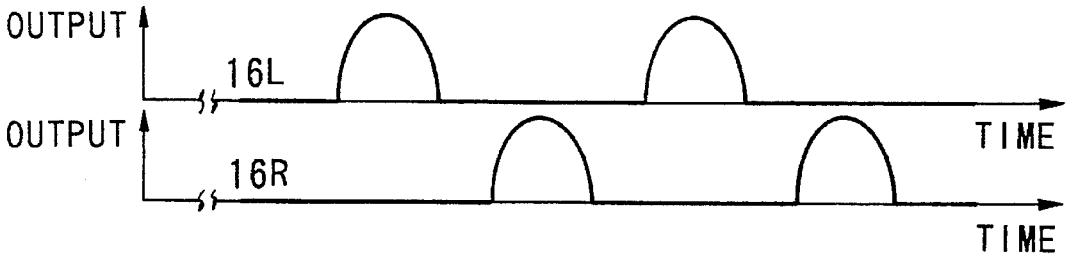
FIG. 4 shows waveforms representing outputs of pressure detecting members shown in FIG. 3.

Next, the operation of the key guide 5 will be described in conjunction with FIG. 3. As described before, at the both sides of the key guide 5, there are provided pressure detecting members 16L, 16R made of the pressure-sensitive rubbers 14, thus forming the guide surfaces. The key 1 is depressed down and returned up along the guide surfaces of the key guide 5 as shown by the arrow A. While depressing the key 1 by the key-depression stroke, the finger of the performer applies the force in directions (see arrows B, C) perpendicular to the key-depressing direction along the guide surfaces so as to laterally move the key 1. When the force is applied in the left-side direction of FIG. 3 (see arrow B), the right-side interior wall of the key 1 presses the right-side pressure detecting member 16R so that this pressure detecting member 16R is activated to produce a detection signal. On the other hand, when the force is applied in the right-side direction (see arrow C), the left-side interior wall of the key 1 presses the left-side pressure detecting member 16L so that this pressure detecting member 16L produces a detection signal. FIG. 4 shows the outputs of the pressure detecting members 16R, 16L. As shown by the waveforms in FIG. 4, by vibrating (or rolling) the key 1 in the lateral direction (i.e., directions corresponding to the arrows B, C), the pressure detecting members 16L, 16R deliver the detection signals in turn.

Figure 5:
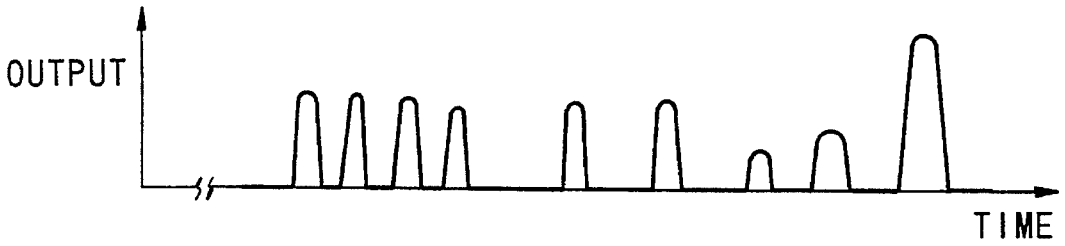
FIG. 5 shows a waveform representing the control manner for an output of the pressure detecting member.

FIG. 5 shows a waveform representing the output of each of the pressure detecting members 16L, 16R. As shown in FIG. 5, it is possible to freely adjust the pitch between the peaks of this waveform and the peak level of this waveform by altering the force which is applied to the key 1 by the finger of the performer. Thus, it is possible to freely control the variation of the speed of the vibrato or variation of the depth of the vibrato in the middle of the key-depressing motion.

(2) Other Examples of Keyboard Units

Figure 6:
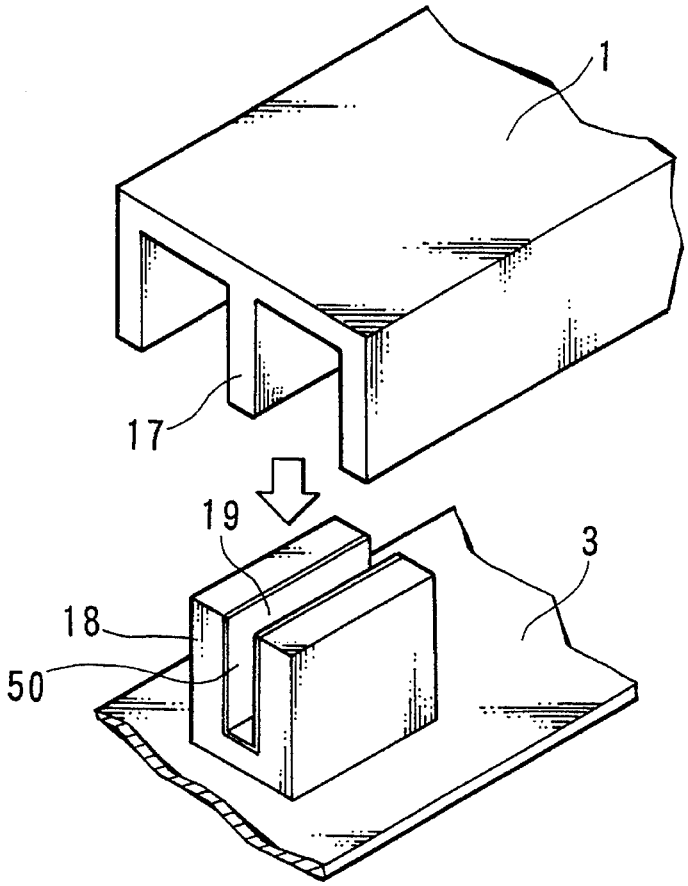
FIG. 6 is a perspective-side view illustrating an assembling manner for the key and key frame.

FIG. 6 shows a construction of the keyboard unit according to another example of the present embodiment.

In this example, a sliding member 17 is formed and projected from an interior wall of the key 1. A guide block 18 which is provided to be matched with the sliding member 17 is mounted on the key frame 3. A guide channel 50 is formed in the guide block 18, so that the sliding member 17 is inserted in this guide channel 50. A pressure sensing member 19 is attached to the inside of the guide channel 50. In the key-depressing motion, the sliding member 17 slides up or down along the interior walls of the guide channel 50. This guide channel 50 functions to regulate the lateral movement of the key and avoid the rolling and twisting motion of the key 1.

Figure 7:
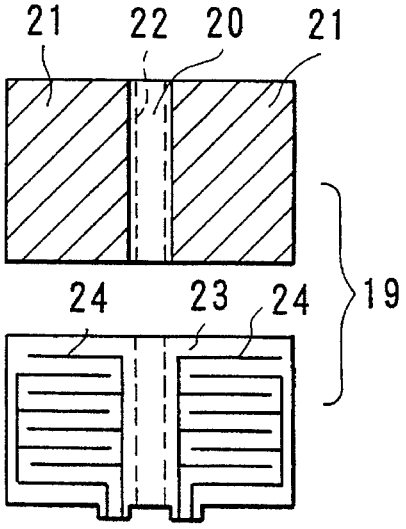
FIG. 7 shows plan views of two sheets by which a pressure sensing member is formed.

As shown in FIG. 7, the above-mentioned pressure sensing member 19 is formed by a pressure-sensitive sheet 20 and an electrode sheet 23. This pressure-sensitive sheet 20 is formed by painting pressure-sensitive materials 21 on a polyester film for example. On the other hand, the electrode sheet 23 is formed by attaching electrodes 24 (e.g., silver electrodes) on the polyester film. These pressure-sensitive sheet 20 and electrode sheet 23 are laminated together such that the pressure-sensitive materials 21 face with the electrodes 24, thus forming the pressure sensing member 19. In FIG. 7, dotted lines 22 indicate folds of the sheets 20, 23. The above-mentioned pressure sensing member 19 is attached to the interior wall of the guide channel 50 provided in the guide block 18. Thus, as similar to the foregoing embodiment, it is possible to detect the rolling pressure of the key 1 in the middle of the key-depressing motion.

Figure 8:
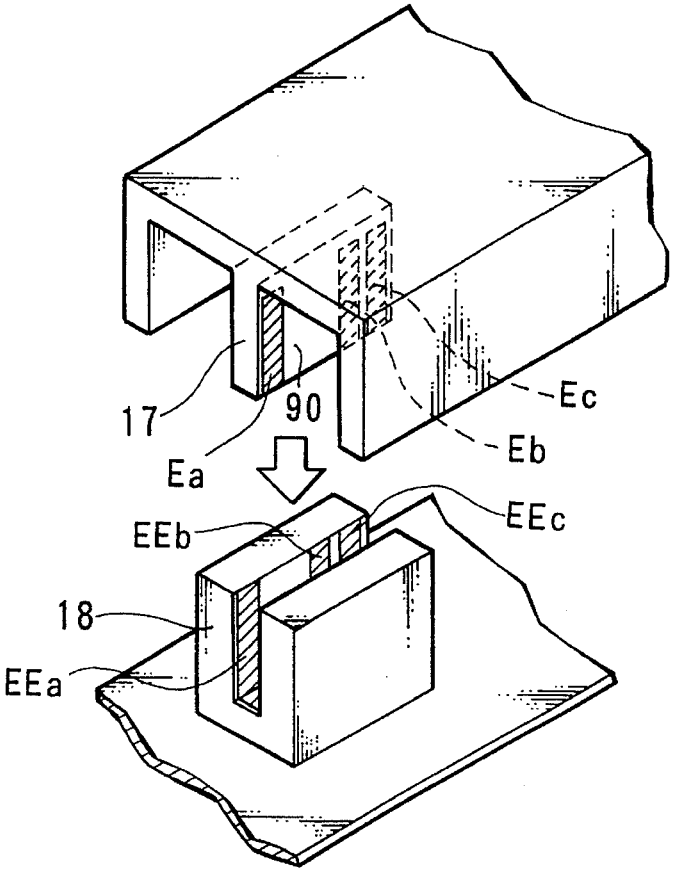
FIG. 8 is a perspective-side view illustrating an assembling manner for the key and key frame according to another example of the first embodiment.
Figure 9:
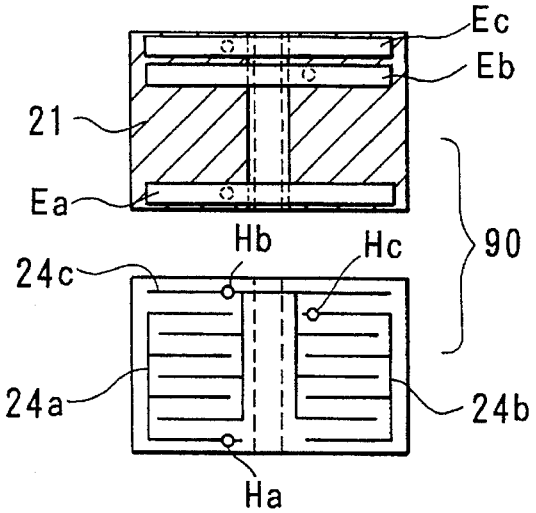
FIG. 9 shows plan views of two sheets by which another pressure sensing member is formed.

The aforementioned example of the keyboard unit as shown by FIGS. 6, 7 can be further modified as shown in FIGS. 8, 9. As compared to the aforementioned example in which the pressure sensing member 19 is attached to the inside of the guide channel 50 of the guide block 18 this modified example is characterized by providing another pressure sensing member 90 to the sliding member 17. Different from the pressure sensing member 19, the pressure sensing member 90 is made by a film on which three electrodes Ea, Eb, Ec are attached. This film is attached to the sliding member 17 such that the electrodes Ea, Eb, Ec are exposed to the outside. On the other hand, other electrodes EEa, EEb, EEc are attached to the interior wall of the guide channel 50. When inserting the sliding member 17 into the guide channel 50, the electrodes Ea, Eb, Ec are respectively placed in contact with the electrodes EEa, EEb, EEl. Therefore, when the key is depressed, the sliding member 17 slides down along the guide channel 50 while the electrodes Ea, Eb, Ec slide in contact with the electrodes EEa, EEb, EEc respectively. The other parts of this pressure sensing member 90 are formed as similar to the foregoing pressure sensing member 19. As shown in FIG. 9, the pressure sensing member 90 is formed by two sheets. Herein, one sheet on which the pressure-sensitive materials 21 are painted provides three electrodes EA Eb Ec while another sheet provides three electrodes 24*a*, 24*b*, 24*c* which are connected by through holes Ha, Hb, Hc. Thus, the rolling pressure applied to the key can be detected by sensing the potential applied between the electrodes EEa and EEc (or EEb and EEc), for example.

In the aforementioned examples, the sliding member 17 has a rectangle shape which is matched with the guide channel 50, so that the sliding member 17 is moved in a vertical direction while sliding with the interior walls of the guide channel 50. In order to easily and accurately detect the depressing pressure applied to the key and the moving distance of the key when the key is depressed down, the aforementioned examples can be further modified with respect to the shapes of the sliding member and guide channel.

Figure 10:
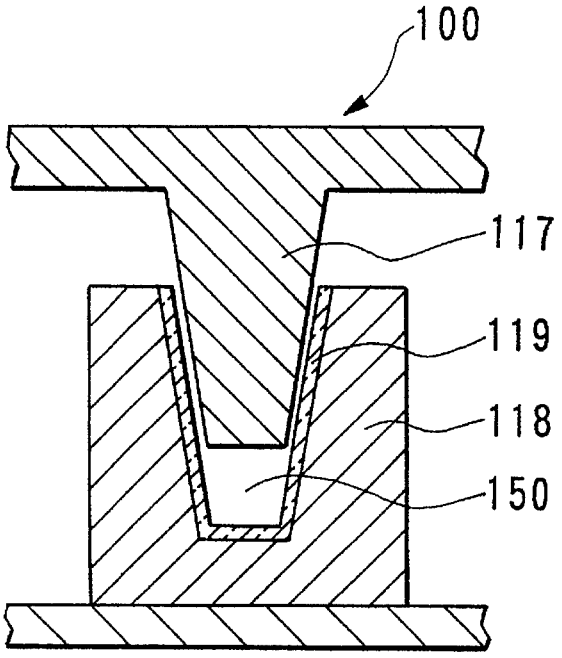
FIG. 10 is a sectional view illustrating a relationship between a sliding member of the key and a guide channel which are engaged with each other when depressing the key.
Figure 11:
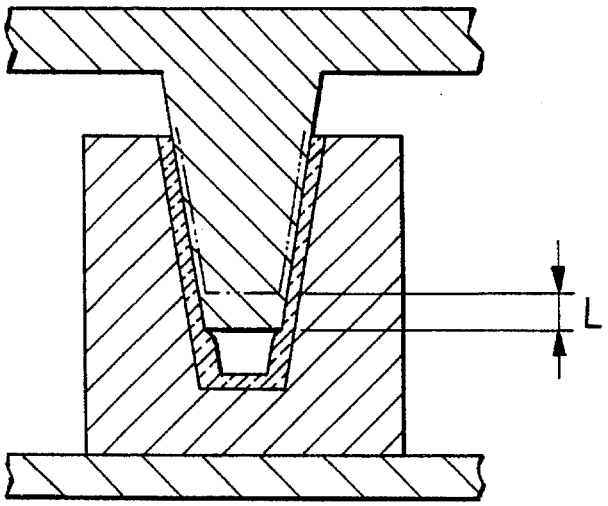
FIG. 11 is a sectional view which is used for explaining the depressing motion of the key by referring to the relationship between the sliding member and pressure sensing member provided along interior walls of the; guide channel.
Figure 12:
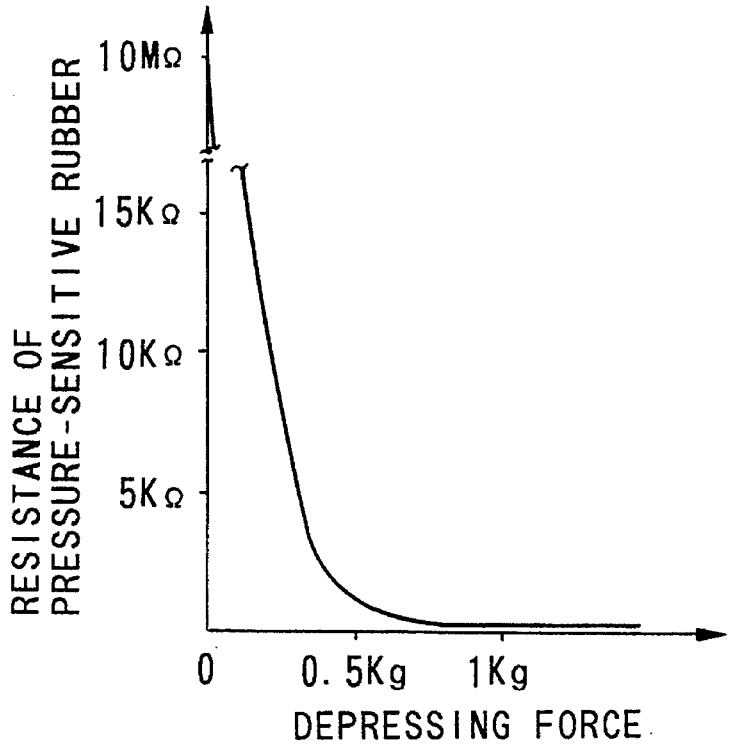
FIG. 12 is a graph representing a characteristic between the depressing force and the resistance of the pressure-sensitive rubber which is used as the pressure sensing member.
Figure 13:
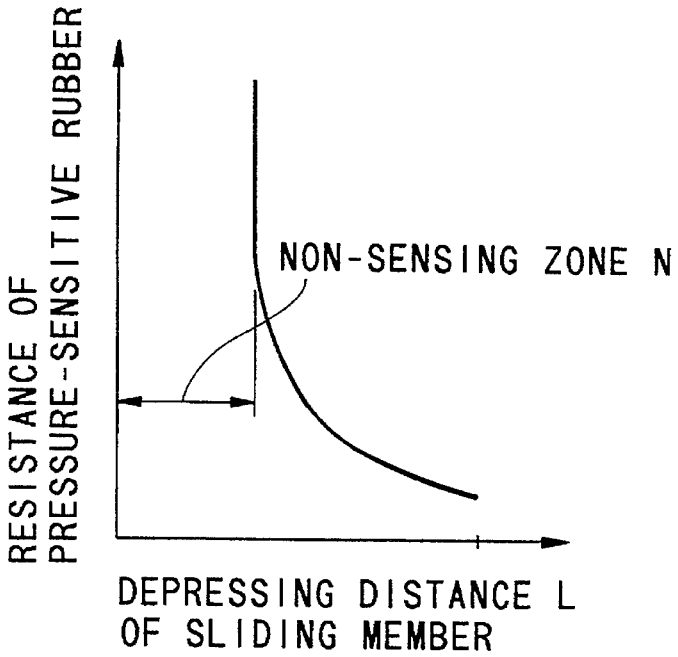
FIG. 13 is a graph representing the relationship between the depressing distance of the sliding member and the resistance of the pressure sensing member in connection with the illustration of FIG. 11.

As shown in, FIGS. 10, 11, a sliding member 117 is roughly formed by a V-shape, while a guide channel 150 is roughly cut by a V-shape. Actually, the sectional shape of the sliding member 117 and guide channel 150 corresponds to the trapezoidal shape. Such V-shaped sliding member 117 is formed to be matched with the V-shaped guide channel 150. Further, a pressure sensing member 119 is attached along with both of inclined interior walls of the V-shaped guide channel 150. This pressure sensing member 119 is made by the pressure-sensitive rubber. In a first state, the sliding member 117 just fits and engages with the guide channel 150 as shown in FIG. 10. Thereafter, when the key is further depressed down, the above-mentioned first state is changed to a second state where the sliding member 117 partially cuts into the pressure sensing member 119 as shown in FIG. 11. Between these two states, a moving distance L (i.e., depressing distance) and a depressing pressure are detected as the variation of the resistance of the pressure-sensitive rubber. FIG. 12 shows a graph representing the relationship between the depressing force and the resistance of the pressure-sensitive rubber. When the thickness of the pressure-sensitive rubber is determined, it is possible to determine the mathematical formula representing the characteristic of the pressure-sensitive rubber, by which the moving distance L can be computed on the basis of the resistance of the rubber. FIG. 13 represents a relationship between the moving distance L and the resistance of the pressure-sensitive rubber.

Figure 14:
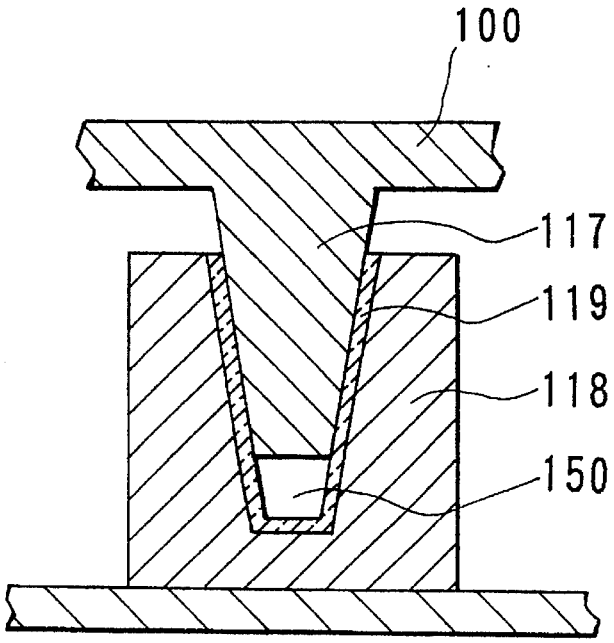
FIG. 14 is a sectional view illustrating another example of the keyboard unit in which the pressure-sensitive ink layer is used as the pressure sensing member and tile guide channel is made by the flexible material.
Figure 15:
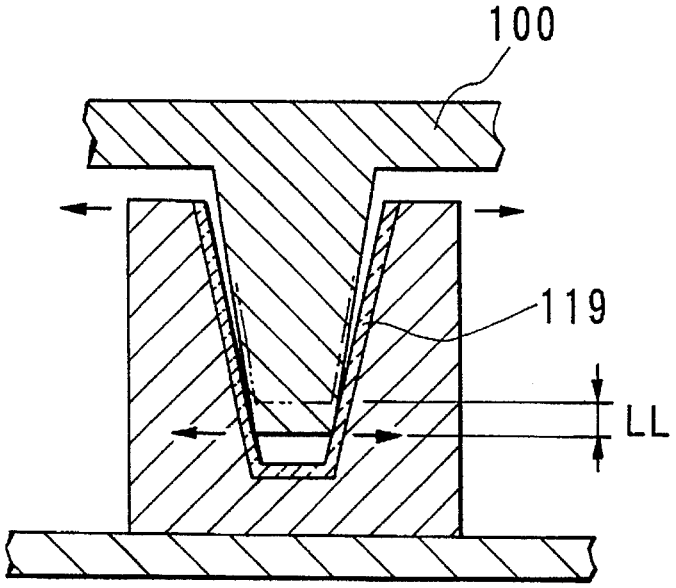
FIG. 15 is a sectional view of which illustration is used for explaining the depressing manner of the keyboard unit shown in FIG. 14.

The above-mentioned example as shown in FIGS. 10, 11 can be further modified as shown in FIGS. 14, 15 wherein the pressure-sensitive ink is employed as the pressure sensing member 119. Different from the sheet of the pressure-sensitive rubber, the sheet containing the pressure-sensitive ink hardly contracts and expands in response to the depressing pressure applied to it. In order to cope with such difficulty, the guide block 118 itself is made by the flexible material such as the flexible plastic. Thus, in response to the depressing pressure which is applied to the pressure-sensitive ink layer 119 and guide block 118, the resistance of the pressure-sensitive ink layer is altered, while the guide block 118 is deformed in a first state, the sliding member 117 just fits and engages with the guide channel 150 as shown in FIG. 14. Thereafter, when the key is further depressed down so that the above-mentioned first state is changed to a second state where the sliding member 117 is further depressed down and consequently both of the side walls of the flexible guide block 118 are expanded as shown in FIG. 15. At this second state, the pressure applied to the contacting portions between the sliding member 117 and pressure-sensitive ink layer 119 is further increased, so that the resistance of the pressure-sensitive ink layer is reduced at the portions contacting with the sliding member 117. Thus, it is possible to detect the moving distance LL and depressing pressure as the variation of the resistance of the pressure-sensitive ink layer 119.

In the aforementioned examples as shown in FIGS. 10, 14, a small key depression or a small key-depressing distance cannot be sensed well because of the responding characteristic of the pressure sensing member 119. Such phenomenon is emerged as a non-sensing zone N in a graph shown in FIG. 13. When the certain key is depressed by the relatively large depressing force, its adjacent key is inevitably vibrated or slightly moved. However, in such event, the pressure sensing member 119 is not activated to sense the pressure applied to the adjacent key because of the existence of the non-sensing zone N. In other words, such non-sensing zone N appeared in the characteristic of the pressure sensing member 119 corresponds to the threshold mechanism which avoids the sharp response to the negligible motion of the key when detecting the key-depressing motion.

(3) Electronic Circuits

Figure 16:
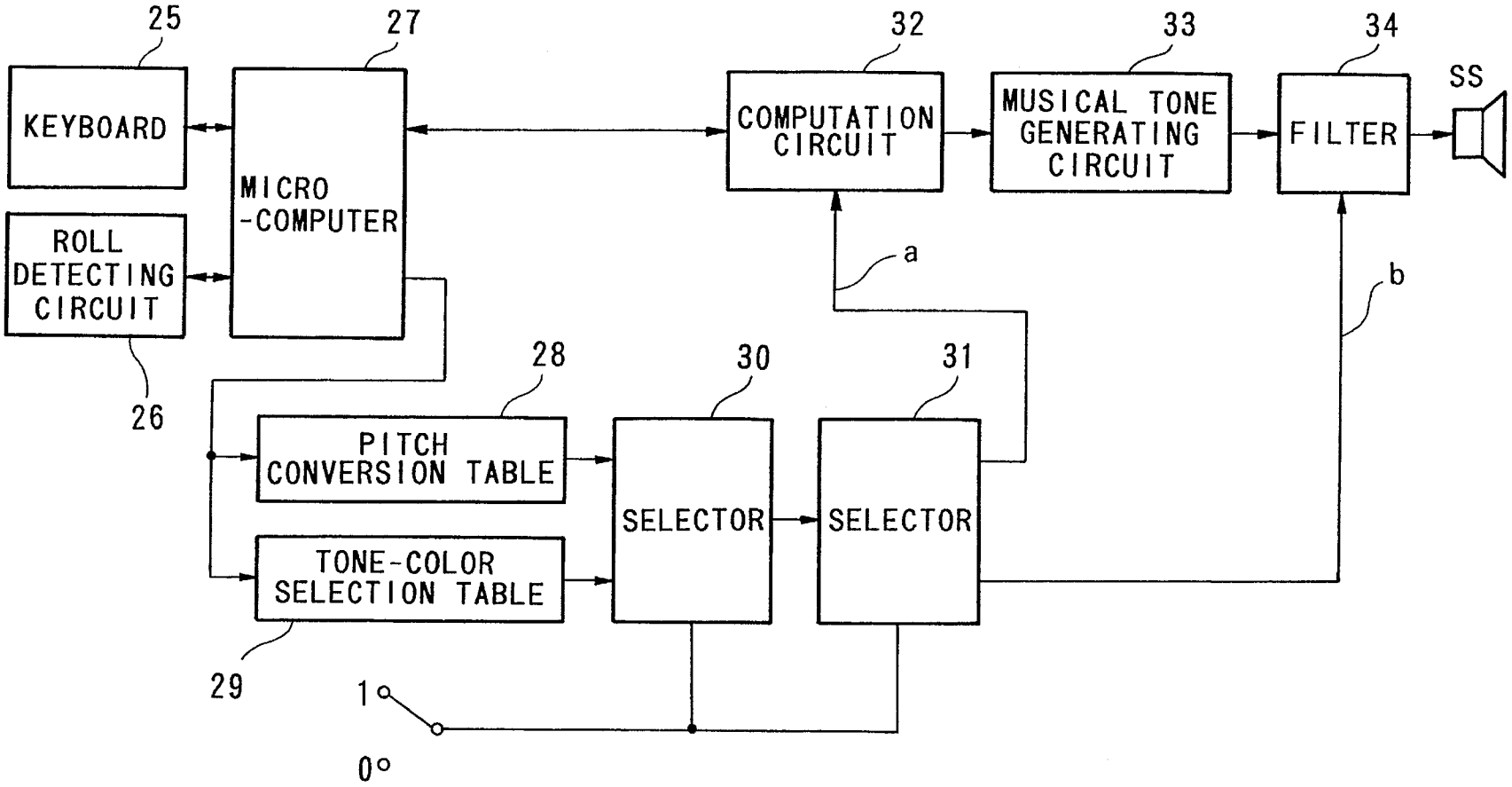
FIG. 16 is a block diagram showing an electronic configuration of the electronic musical instrument according to the first embodiment of the present invention.

FIG. 16 is a block diagram showing electronic circuits provided in an electronic musical instrument having the aforementioned keyboard unit. In FIG. 16, a micro-computer 27 is connected with a keyboard 25 and a roll detecting circuit 26 which contains electric circuits for the foregoing pressure sensing member and the like. The keyboard 25 delivers the key-on signal and keycode corresponding to the depressed key to the micro-computer 27, while the roll detecting circuit 26 delivers roll detection signals in a time-division manner to the microcomputer 27. Herein, the roll detection signal represents the rolling motion (or lateral movement) of the key. The microcomputer 27 is connected with a pitch conversion table 28 and a tone-color selection table 29. The pitch conversion table 28 converts the roll detection signal into the data representing the pitch-altering amount. In the present embodiment, this pitch-altering amount is set proportional to the amount of the rolling motion of the key. The tone-color selection table 29 converts the roll detection signal into the data representing the cut-off frequency for a filter 34. In the present embodiment, this cut-off frequency is set proportional to the amount of the rolling motion of the key. The output data of the tables 28, 29 are respectively supplied to a computation circuit 32 and the filter 34 by means of two selectors 30, 31. More specifically, the selectors 30, 31 are switched over in response to the operating state of the selecting switch, so that the outputs of the tables 28, 29 are selectively supplied to the computation circuit 32 and filter 34. The computation circuit 32 is configured by multipliers and/or adders, so that the keycode outputted from the micro-computer 27 and the output data of the pitch conversion table 28 are subjected to the predetermined computation containing the multiplication process and/or addition process. Thus, the computation circuit 32 computes the tone pitch (i.e., frequency number called as "f-number") of the musical tone to be generated.

This data representing the computed tone pitch is supplied to a musical tone generating circuit 33.

The musical tone generating circuit 33 provides plural channels which are respectively operated in a time-division manner, so that it can simultaneously generate plural musical tone signals. When receiving the key-on signal from the keyboard 25, the micro-computer 27 selects one channel from which the musical tone signal corresponding to the depressed key is to be generated. Thus, the micro-computer 27 sends the keycode corresponding to the depressed key to the computation circuit 32 at the time slot corresponding to the selected channel. In order that the data of pitch-altering amount corresponding to the depressed key is supplied to the computation circuit 32 in synchronism with the time slot corresponding to the channel which is assigned to the depressed key, one of the roll detection signals which corresponds to the depressed key is selectively delivered to the pitch conversion table 28 under control of the micro-computer 27. The roll detection signals are intermittently outputted from the roll detecting circuit 26 as long as the key is depressed. In response to the variation of the roll detection signals, the tone pitch of the musical tone signal to be generated is altered.

The musical tone signal generated from the musical tone generating circuit 33 is supplied to the filter 34. As similar to the musical tone generating circuit 33, this filter 34 operates in a time-division manner. It is configured by the low-pass filter, high-pass filter or band-pass filter. Therefore, this filter 34 performs the filtering operation on the musical tone signal inputted thereto so as to control the tone color of the musical tone signal. The cut-off frequency of the filter 34 is determined by the data of cut-off frequency which is supplied from the tone-color selection table 29 by means of the selectors 30, 31. In order that the data of cut-off frequency is supplied to the filter 34 in synchronism with the time slot corresponding to the channel which is assigned to the depressed key, one of the roll detection signals which corresponds to the depressed key is selectively delivered to the tone-color selection table 29 under control of the micro-computer 27. As described before, the roll detection signals are intermittently outputted from the roll detecting circuit 26 as long as the key is depressed. In response to the variation of the roll detection signals, the tone color of the musical tone signal to be generated is altered.

The musical tone signals outputted from respective channels of the musical tone generating circuit 33 are passed through the filter 34 and then accumulated, so that the corresponding musical tones are sounded from a sound system SS.

Figure 17:
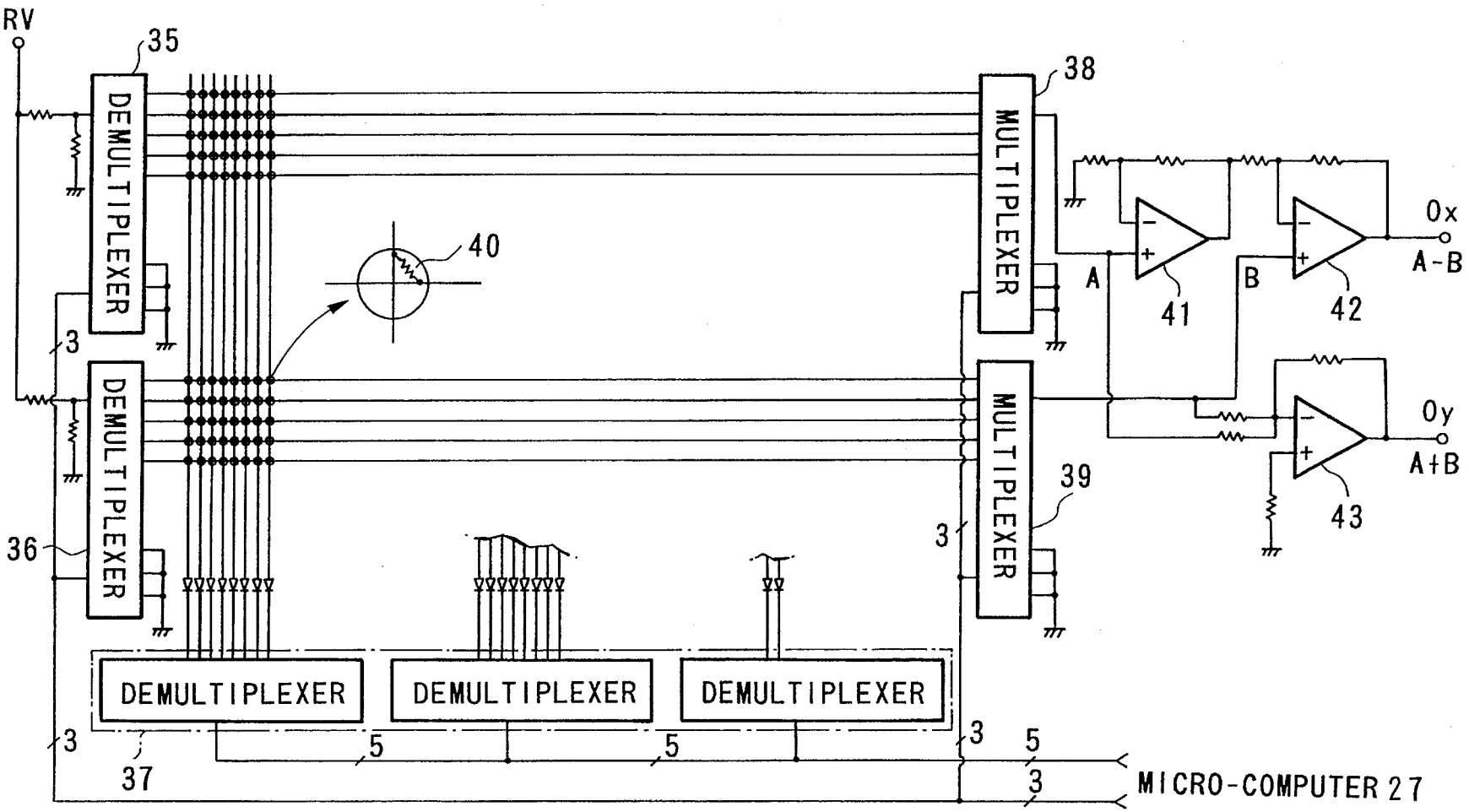
FIG. 17 is a block diagram showing a detailed electric circuitry for a roll detection circuit shown in FIG. 16.

FIG. 17 shows an example of the circuit configuration of the roll detecting circuit 26. "This circuitry is designed to detect the after touch and the output of the foregoing pressure sensing member. The micro-computer 27 delivers two kinds of control signals, i.e., 3-bit control signal and 5-bit control signal. The 3-bit control signal is delivered to demultiplexers 35, 36, while the 5-bit control signal is delivered to demultiplexers 37. The demultiplexer 35 is connected with the pressure sensing elements (corresponding to the foregoing pressure-sensitive rubber or pressure-sensitive link) provided at the left-side face of the key guide, while another demultiplexer 36 is connected with the other pressure sensing elements provided at the right-side face of the key guide. At each of the intersections between the lines of the demultiplexers 35, 36, 37, there is provided a pressure sensing element 40 as the resistor. The number of the intersections corresponds to the number of the keys provided in the keyboard unit. In the present embodiment, two pressure sensing elements are provided for each of the keys, resulting that the number of the intersections is twice as compared to the number of the keys. These pressure sensing elements 40 respectively provided at the intersections of the matrix circuits are scanned by the micro-computer in the predetermined direction by the time-division manner, thus detecting the rolling pressure applied to the key which is depressed and vibrated by the finger of the performer. The results of the detection are delivered to an output circuit by means of multiplexers 38, 39 which respectively correspond to the left-side and right-side matrix circuits. This output circuit is configured by three amplifiers 41, 42, 43. The multiplexer 38 outputs a detection result A which is obtained from the pressure sensing elements arranged in the left-side matrix circuit, while another multiplexer 39 outputs another detection result B which is obtained from the pressure sensing elements arranged in the right-side matrix circuit. The amplifiers 41, 42 combines these detection results A, B so as to output a difference (A–B) at a terminal Ox. On the other hand, the amplifier 43 combines these detection results A, B so as to output a sum (A+B)at a terminal Oy.

The output signals obtained from the above-mentioned terminals Ox, Oy are supplied to the micro-computer 27 (see FIG. 16). These output signals are used as the control signals for the vibrato effect, for example. When being applied to the electronic musical instruments, these signals can be used for controlling several kinds of parameters representing the tone pitch, tone color, depth and speed of the tremolo, reverberation depth, weighing operations for PAN, PCM and FM operations, tone-volume balance, tone volume, key-scaling for the pitch and the like.

The aforementioned output circuit containing the amplifiers 41, 42, 43 is used for processing the outputs of the multiplexers 38, 39. The circuit configuration of this output circuit can be modified by employing the other circuit elements. For example, this output circuit can be redesigned such that the difference signal for the modulation can be obtained from the detection signals A, B and the signal of which value is proportional to the pressure applied to the pressure sensing element can be also obtained. Or, it is possible to further modify the output circuit such that the pressure-detection result corresponding to either the left-side pressure sensing elements or the right-side pressure sensing elements are selectively picked up. Furthermore, the output circuit can be re-designed such that the certain parameter representing the tone pitch, tone color or tone volume is controlled by both of the pressure-detection results obtained from the left-side and right-side pressure sensing elements.

In the electric circuitry as shown in FIGS. 16, 17, the tone pitch and/or tone color of the musical tone to be generated is controlled responsive to the roll detection signal produced from the roll detecting circuit 26. However, in the examples as shown in FIGS. 10, 14 in which the moving distance of the key in the key-depressing direction can be detected, the tone pitch and/or tone color of the musical tone to be generated can be controlled on the basis of this moving distance of the key, instead of the rolling motion of the key.

[B] Second Embodiment

Figure 18:
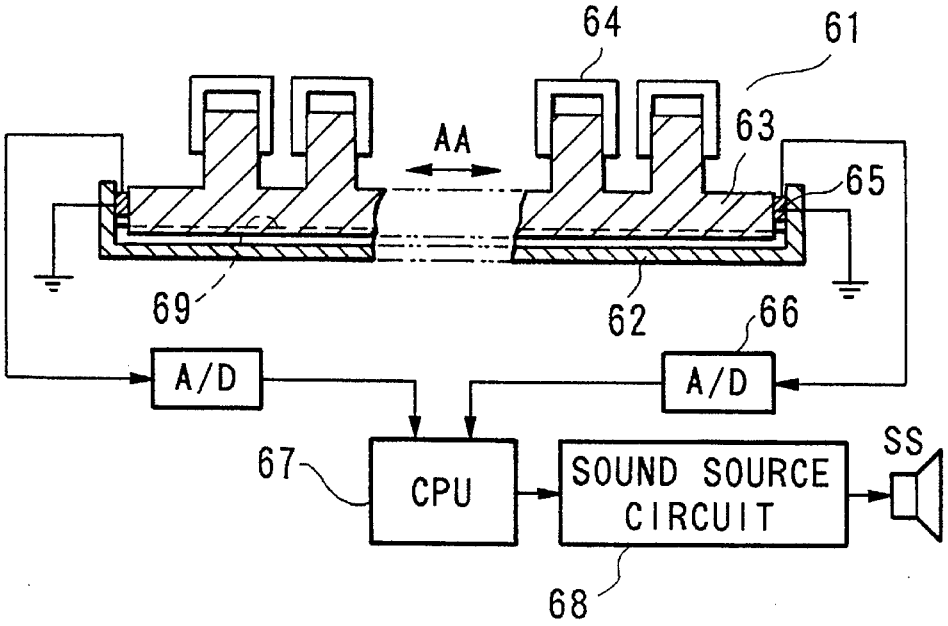
FIG. 18 is a drawing illustrating a mechanical structure and an electronic structure of a keyboard unit of an electronic musical instrument according to a second embodiment of the present invention.

Next, the description will be given with respect to the keyboard unit of the electronic musical instrument according to a second embodiment of the present invention by referring to FIG. 18. Herein, a keyboard 61 is constructed by a key frame 62, a key guide 63 and plural keys 84. These keys 64 are linearly disposed in parallel on the key guide 63. The key frame 2 is securely fixed to the main-frame structure of the instrument (not shown). The key guide 63 can be moved in a lateral direction (i.e., disposing direction of the keys 64, see arrow AA) within the key frame 62 which is securely fixed to the instrument. On the key frame 62, there are provided electronic circuit boards on which switching circuits for detecting the key-depression events of the keys 64 are mounted.

Figure 19:
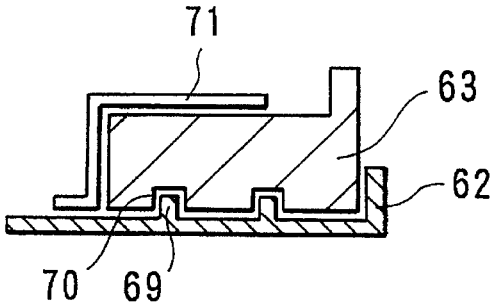
FIG. 19 is a sectional view illustrating the detailed construction of the keyboard unit shown in FIG. 18.

As the moving mechanism of the key guide 63, a pair of guide rails 69 are laid on the upper surface of the key frame 62, wherein these guide rails 69 extend in the lateral direction as shown in FIG. 19. Further, guide channels 70 are formed at the lower-face portion of the key guide 63 such that they can engage with the guide rails 69. Thus, the key guide 63 can slide along with the guide rails 69 of the key frame 62 in the lateral direction corresponding to the disposing direction of the keys 64. A stopper 71 is attached at the front portion of the key frame 62 such that the key guide 63 does not depart from the key frame 62.

Further, there are provided pressure sensors 65 at both of the side portions of the key frame 62 respectively. Each of the pressure sensors 65 is connected with a central processing unit (i.e., CPU) 67 by means of an analog-to-digital converter 66. This CPU 67 is made of the micro-computing unit and the like. On the basis of control signals which control several kinds of parameters representing the tone pitch, tone color, tone volume and the like, the CPU 7 produces signal waveforms for electronic sounds. These signal waveforms are supplied to a sound source circuit 68.

Next, the detailed description will be given with respect to the operation of the keyboard unit having the above-mentioned structure. Herein, the tone pitch is designated by depressing the certain key 64 provided in the keyboard 61. The key-depression event is detected by a key-depression detecting circuit (not shown). Responsive to the detected key-depression event, the CPU 7 is activated to produce the key-on signal for the depressed key. In the State where the key 64 is depressing, when the performer moves the key guide 63 in the lateral direction, the key guide 63 travels along with the guide rails 69 of the key frame 62 in the direction AA corresponding to the disposing direction of the keys 64. Due to the traveling motion (or swinging motion) of the key guide 63, the pressing force which is applied to each or, the side portions of the key frame 62 by the key guide 63 is altered. Then, the variation of this pressing force is detected by the pressure sensor 65, so that the pressure sensor 65 produces a swing-motion signal to the CPU 7. This swing-motion signal is produced in response to the variation of the pressure applied to the pressure sensor 65, and it represents the moving distance and moving velocity of the key guide 63. Responsive to the swing-motion signal, the CPU 7 corrects (or partially alters) the tone pitch designated by the key-on signal which is produced for the depressed key. Then, the corrected tone pitch is sent to the sound source circuit 68. The sound source circuit 68 produces a signal representing the electronic sound having the;corrected tone pitch. Thereafter, the sound system SS produces the electronic sound.

By the above-mentioned operation, it is possible to effect the slight pitch-bending operation or impart the vibrato effect on the tone pitch of the musical sound which is designated by depressing the key.

In the aforementioned embodiment, the pressure sensors 65 are attached to the side portions of the key guide 63. However, this embodiment can be modified to shift the attaching positions of the pressure sensors 65. For example, the pressure sensor can be attached at the middle position between the key guide and key frame by which the variation of the pressure can be sensed well. Of course, the number of the pressure sensors is not limited to two. Therefore, only one pressure sensor can be provided, or three pressure sensors are provided in order to improve the reliability of the pressure sensing operation.

Further, the pressure sensor can be replaced by other sensors and the like which can detect the lateral movement of the key guide 63. Therefore, it is possible to employ several kinds of sensors, which can sense the swing motion of the key guide as the analog value, such as the electric sensor which operates based on the variation of the resistance, optical sensor and magnetic sensor.

Furthermore, the present, embodiment is designed to control the tone pitch in response to the lateral movement of the key guide 63. However, it is possible to modify the present embodiment such that the tone volume is controlled responsive to the lateral movement of the key guide so as to obtain the tremolo effect. Other than the tone pitch and tone volume, it is possible to use several kinds of musical parameters such as the tone color, echo effect and reverberation effect as the controlled matter which is controlled responsive to the lateral movement of the key guide.

Figure 20:
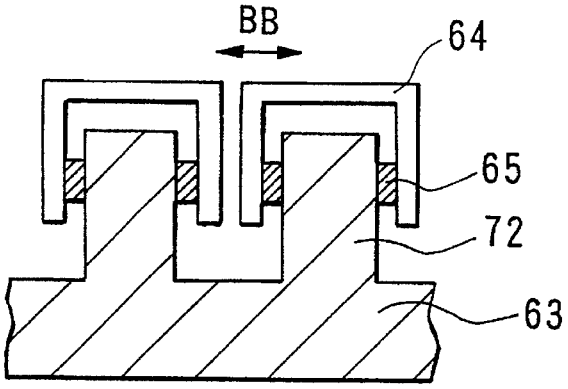
FIG. 20 is a sectional view illustrating the detailed structure of the keyboard unit according a modified example of the second embodiment.

FIG. 20 shows a modified example of the second embodiment. In this example, each of the keys 64 is mounted on a key supporting portion 72 which is projected from the key guide 63, wherein the pressure sensors 65 are provided between the interior walls of the key 64 and the side walls of the key supporting portion 72. Different from the second embodiment shown in FIG. 18, the key guide 63 is securely fixed to the main-frame structure of the instrument by means of the key frame (not shown). Each of the keys 64 can be swung about the key supporting portion 72 in the disposing direction of the keys 64 (see arrow BB). In this case, while depressing the key 64 by the finger of the performer, the key 64 is swung in the lateral direction BB. Thus, the pressure sensors 65 detect this swinging motion of the key 64 so as to output the detection signal to the CPU. Then, as similar to the foregoing second embodiment, it is possible to perform a delicate control on the musical sound.

Figure 21:
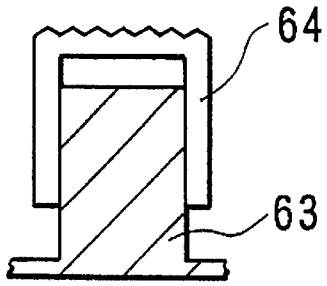
FIGS. 21, 22 and 23 are sectional views each illustrating a modified shape of the key used in the keyboard unit according to the second embodiment.
Figure 22:
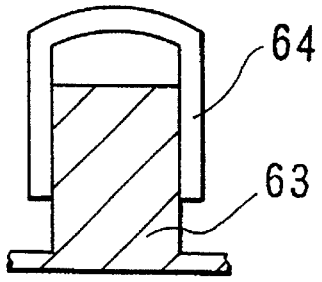
Figure 23:
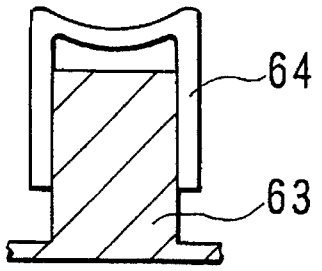

FIGS. 21 through 23 show desirable shapes for the keys which are suitable for the keyboard unit applied to the present embodiment. In an example of the key shown in FIG. 21, a plurality of grooves are formed on the upper surface of the key 64 in a longitudinal direction. Instead of using these grooves, the upper surface of the key 64 can be formed as the rough surface on which small irregularities are formed. FIG. 22 shows an example of the key of which upper surface is formed in the concave shape. FIG. 23 shows another example of the key of which upper surface is formed in the convex shape. As compared to the key of which upper surface is formed in the flat shape, these keys as shown in FIGS. 21 through 23 are effective when swinging the key because of the good hold for the finger in the lateral direction. Thus, it is possible to easily and certainly swing the key in the lateral direction, which can raise the performability for the keyboard when applying the vibrating motion (or swinging motion) on each of the keys.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A keyboard unit for an electronic musical instrument comprising:

a plurality of keys;

a key frame on which said plurality of keys are arranged such that each of said keys freely rotates when depressed;

a plurality of key guides which are provided on said key frame wherein each of said key guides includes a guide surface and each of said key guides supports at least one of said keys such that each of said supported keys slides along at least one guide surface when said key is depressed; and a plurality of pressure sensors wherein at least one pressure sensor is provided at each of said guide surfaces, each of said pressure sensors sensing pressure applied thereto in a lateral direction corresponding to a disposing direction of a respective supported key when said respective supported key is depressed, whereby when a respective at least one of said keys is moved in the lateral direction while being depressed down, said respective at least one pressure sensor senses the pressure applied to said at least one key in the lateral direction so that a predetermined musical parameter of a musical tone to be generated is controlled responsive to sensed pressure.

2. A keyboard unit for an electronic musical instrument as defined in claim 1 wherein said predetermined musical parameter is a tone pitch.

3. A keyboard unit for an electronic musical instrument comprising:

a plurality of keys each providing a sliding member;

a key frame on which said plurality of keys are arranged such that each of said keys freely rotates when depressed;

a plurality of key guides which are provided on said key frame, each of said key guides providing a guide channel which is shaped to engage a respective sliding member of one of said keys each of said key guides supporting the respective key by engaging said respective sliding member with its guide channel when said key is depressed; and a plurality of pressure sensing members wherein a respective pressure sensing member is provided at an interior wall of said guide channel, so that said pressure sensing member senses pressure applied thereto in a lateral direction corresponding to a disposing direction of a respective one of said keys in the keyboard unit when said key is depressed, whereby when said respective one of said keys is moved in the lateral direction while being depressed down, said pressure sensing member senses the pressure applied to said key in the lateral direction so that a predetermined musical parameter of a musical tone to be generated is controlled responsive to sensed pressure.

4. A keyboard unit for an electronic musical instrument as defined in claim 3 wherein each of said sliding members and said guide channels has have a roughly V-shape so that they can engage with each other, each of said guide channels includes an inclined wall and said respective pressure sensing member is attached to said inclined wall.

5. A keyboard unit for an electronic musical instrument as defined in claim 3 wherein at least one of said pressure sensing members includes pressure-sensitive rubber of which resistance is altered responsive to pressure applied to it.

6. A keyboard unit for an electronic musical instrument as defined in claim 3 wherein at least one of said pressure sensing members includes pressure-sensitive ink of which resistance is altered responsive to pressure applied to it.

7. A keyboard unit for an electronic musical instrument as defined in claim 4 where said key guide is constructed of a flexible material so that said guide channel can be deformed when said respective sliding member is depressed therein.

8. A keyboard unit for an electronic musical instrument comprising:

a plurality of keys;

a key frame on which said plurality of keys are arranged such that each of said keys freely rotates;

a key guide which is mounted on said key frame such that it can be freely moved in a lateral direction, said key guide providing a plurality of key supporting portions each of which supports at least one of said keys such that said supported keys can be freely depressed down in a vertical direction perpendicular to the lateral direction; and a pressure sensor which is provided between said key frame and said key guide such that it can sense a lateral movement of said key guide, whereby a predetermined musical parameter of a musical tone to be generated is controlled responsive to a sensed lateral movement of said key guide.

9. A keyboard unit for an electronic musical instrument as defined in claim 8 wherein a guide rail extending in the lateral direction is laid on an upper; surface of said key frame, while a guide channel engaging with said guide rail is formed at a lower-face portion of said key guide which contacts with said key frame, so that said key guide can be moved in the lateral direction along said guide rail.

10. A keyboard unit for an electronic musical instrument as defined in claim 8 wherein an upper surface of each of said keys is formed in a predetermined shape by which a finger of a performer can be held well when moving said key in the lateral direction.

11. A keyboard unit for an electronic musical instrument comprising:

a plurality of keys;

a key supporting means on which said plurality of keys are arranged such that each of said keys freely rotates in response to a depressing motion applied to said key by a player of the electronic musical instrument;

a plurality of key guides which are provided on said key supporting means, wherein each of said key guide includes a guide surface and each of said keys slides along at least one of said guide surfaces when depressed;

a plurality of sensors which are respectively provided at said guide surfaces of said key guides, each of said sensors detecting a moving distance of a respective key when said respective key is depressed; and a control means for controlling a musical tone signal based on a detected moving distance of said respective key.

12. A keyboard unit for an electronic musical instrument as defined in claim 11 wherein each of said keys has a sliding member roughly having a V-shape, each of said key guides having a guide channel roughly having a V-shape, which engages with a respective one of said sliding members each of said sensors including a pressure sensing member which is attached to an inclined wall of a respective V-shaped guide channel.

13. A keyboard unit for an electronic musical instrument as defined in claim 12 wherein said pressure sensing member includes pressure-sensitive rubber of which resistance is altered responsive to pressure applied to it, so that the moving distance of said key is detected on the basis of a variation of the resistance of said pressure-sensitive rubber.

14. A keyboard unit for an electronic musical instrument comprising:

a plurality of keys;

a key supporting means on which said plurality of keys are arranged such that each of said keys freely rotates in response to a depressing motion applied to said key by a player of the electronic musical instrument;

a plurality of key guides which are provided on said key supporting means, wherein each of said key guides includes a guide surface and each of said keys slides along at least one of said guide surfaces when depressed;

a plurality of sensors which are respectively provided at said guide surfaces of said key guides, each of said sensors detecting a depressing pressure which is applied to a respective key when said respective key is depressed; and a control means for controlling a musical tone signal based on a detected depressing pressure.

15. A keyboard unit for an electronic musical instrument as defined in claim 14 wherein each of said keys has a sliding member roughly having a V-shape, each of said key guides having a guide channel roughly having a V-shape, which engages with a respective one of said sliding members, each of said sensors including a pressure sensing member which is attached to an inclined wall of a respective V-shaped guide channel.

16. A keyboard unit for an electronic musical instrument comprising:

a plurality of keys;

a key supporting means on which said plurality of keys are arranged such that each of said keys is freely rotatable in response to a depressing force applied by a player of the electronic musical instrument;

a plurality of key guides which are provided on said key supporting means, wherein each of said key guides includes a guide surface and each of said keys slides along at least one of said guide surfaces when depressed;

a plurality of sensors which are respectively provided at said guide surfaces of said key guides, each of said sensors detecting a moving distance of a respective key in a lateral direction corresponding to a disposing direction of said respective key when said respective key is depressed; and a control means for controlling a musical tone signal based on a detected moving distance of said respective key in the lateral direction.

17. A keyboard unit for an electronic musical instrument as defined in claim 16 wherein each of said sensors includes pressure-sensitive rubber of which resistance is altered responsive to pressure applied to it, so that the moving distance of said respective key is detected on the basis of a variation of the resistance of the pressure-sensitive rubber.

18. A keyboard unit for an electronic musical instrument comprising:

a plurality of keys;

a key frame on which said plurality of keys are arranged such that each of said keys is freely rotatable in response to a depressing force applied by a player of the electronic musical instrument;

a plurality of key guides which are provided on said key frame, wherein each of said key guides includes a guide surface and each of said keys slides along at least one of said guide surfaces when depressed;

a plurality of sensors which are respectively provided to said keys at positions respectively facing said guide surfaces of said key guides, each of said sensors detecting a pressure applied thereto in a lateral direction corresponding to a disposing direction of a respective key when said respective key is depressed; and a control means for controlling a musical tone signal based on a detected pressure of said respective key-in the lateral direction.

* * * * *